US005092801A

United States Patent [19]

McBeth

[11] Patent Number: 5,092,801

[45] Date of Patent: Mar. 3, 1992

[54] HYDRAULIC STEERING ASSEMBLY FOR OUTBOARD MARINE ENGINES

[75] Inventor: James B. McBeth, N. Vancouver, Canada

[73] Assignee: Teleflex Incorporated, Limerick, Pa.

[21] Appl. No.: 602,492

[22] Filed: Oct. 24, 1990

[51] Int. Cl.[5] ..... B63H 5/12

[52] U.S. Cl. ..... 440/61; 440/900; 114/144 R; 114/150

[58] Field of Search ..... 440/53, 61-63; 114/144 R, 162, 163, 150

[56] References Cited

U.S. PATENT DOCUMENTS 4,373,920 2/1983 Hall et al. ..... 440/59

5,002,510 3/1991 Rump ..... 440/53 X

*Primary Examiner*—Ed Swinehart

*Attorney, Agent, or Firm*—Reising, Ethington, Barnard, Perry & Milton

[57] ABSTRACT

A hydraulic steering assembly (10) connected to the tiller arm (24) of an outboard marine engine (22) includes a piston rod (36) supported for arcuate movement about the tilt axis (B) while remaining parallel thereto. A hydraulic cylinder (42) travels along the piston rod (36). An arm (70) extends from the cylinder (42) to a first pivotal member (64) establishing a first pivotal connection about an axis (C) parallel to the tilt axis (B). A rigid link (68) extends between the first pivotal member (64) and a second pivotal member (66). The second pivotal member (66) is also connected to the tiller arm (24) and establishes a second pivotal connection about an axis (D) perpendicular to the tilt axis (B). As the cylinder (42) travels back and forth across the rod (36), the piston rod (36) oscillates about the tilt axis (B), the cylinder (42) rotates about the piston rod (36), the arm (70) rotates about the first pivotal member (64) and the link (68) rotate about the tiller arm (24) in a concerted motion providing a strong and compact linkage arrangement.

34 Claims, 4 Drawing Sheets

B
44
48
50
52
54
56
40
4
4
10
32
36
34
42
24
58
D,62
66
78
68
30
70
74
72
64
82
60
C
58'
66'
64'
68'
90

HYDRAULIC STEERING ASSEMBLY FOR OUTBOARD MARINE ENGINES

TECHNICAL FIELD

The subject invention relates to a hydraulic steering assembly to be attached to the tiller arm of an outboard propulsion unit for a boat to rotate the propulsion unit about a steering axis.

BACKGROUND ART

Many boats are powered by an engine supported outboard and hydraulically controlled from a steering wheel located remotely from the engine. A hydraulic steering assembly is attached to the tiller arm of the engine and moved in response to hydraulic pressure created during rotation of the steering wheel.

The prior art hydraulic steering assemblies teach the advantages of continuously supporting a hydraulic piston rod parallel to the tilt tube axis of the engine and then attaching a travelling cylinder to the tiller arm. As shown in the U.S. Pat. No. 4,373,920 to Hall et al, issued Feb. 15, 1983, the travelling cylinder can be attached to the tiller arm by a slider mechanism wherein a lost motion connection is established between the tiller arm and the cylinder in order to compensate for the arcuate movement of the tiller arm. Alternatively, a drag link mechanism can be pivotally attached between one end of the cylinder and the tiller arm. The slider type and drag link type connections each have unique advantages and disadvantages.

The advantages of the drag link is that it is strong and simple. The primary disadvantage is that the drag link must be very long in order to maximize force transfer between the cylinder and the tiller arm. That is, if the drag link is very short, at certain angular positions of the tiller arm it will cock relative to the movement of the cylinder and apply reactionary forces to the cylinder nearly transverse to the direction of cylinder travel. In order to prevent this, a long drag link is typically attached to one end of the cylinder. However, the end of the cylinder adjacent the drag link attachment experiences higher loads than the other end of the cylinder. These loads have a component force in directions transverse to the piston rod causing the hydraulic seals between the cylinder and the piston rod to wear rapidly and hence, leak hydraulic fluid.

Alternatively, the slider type connection between the cylinder and the tiller arm is advantageous in that the connection can be made at the mid point between the ends of the cylinder, thereby evenly distributing the loads between the ends of cylinder, and hence preserving the life of the hydraulic seals. Also, the slider connection is advantageous in that the loads typically do not have components of force in directions transverse to the piston rod. However, the slider type connection has the inherent disadvantage that the sliding surfaces frequently bind due to wear. Also, lost motion connections are susceptible to seizure when debris becomes wedged between the sliding surfaces.

SUMMARY OF THE INVENTION AND ADVANTAGES

The subject invention contemplates a hydraulic steering assembly of the type for rotating a propulsion unit about a steering axis in response to a force applied to a tiller arm thereof with the propulsion unit being supported for arcuate movement about the tilt axis generally perpendicular to the steering axis. The steering assembly comprises an elongated piston rod, a cylinder surrounding the piston and linearly moveable therealong, support means for supporting the rod parallel to the tilt axis and allowing arcuate movement of the rod about the tilt axis while maintaining the rod parallel to the axis. The subject invention is characterized by including connector means for pivotally connecting a fixed predetermined point between the ends of the cylinder to a fixed predetermined point on the tiller arm for allowing relative movement between the cylinder and the tiller arm while the rod remains parallel to the tilt axis.

According to another aspect of the subject invention, the connector means is adapted to connect a predetermined point between the ends of the cylinder to a predetermined point on the tiller arm for transferring forces between the cylinder and the tiller arm along directions continuously parallel to the rod whereby stresses between the rod and the cylinder are reduced by allowing a predetermined point on the cylinder to approach a midpoint between the end thereof.

The unique connector means of the subject invention combines the advantages of the slider type connection of the prior art with the drag link connection of the prior art. More particularly, the connector means provides a strong and simple universal connection between the hydraulic steering assembly and the tiller arm of the engine while eliminating a lost motion type slider connection inherently susceptible to abrasive degradation and jamming. Further, the connector means provides a compact connection for allowing attachment to the cylinder to the mid point thereof, to more evenly distribute stresses between the cylinder and its piston rod to prevent premature failure of the seals at either end of the cylinder.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
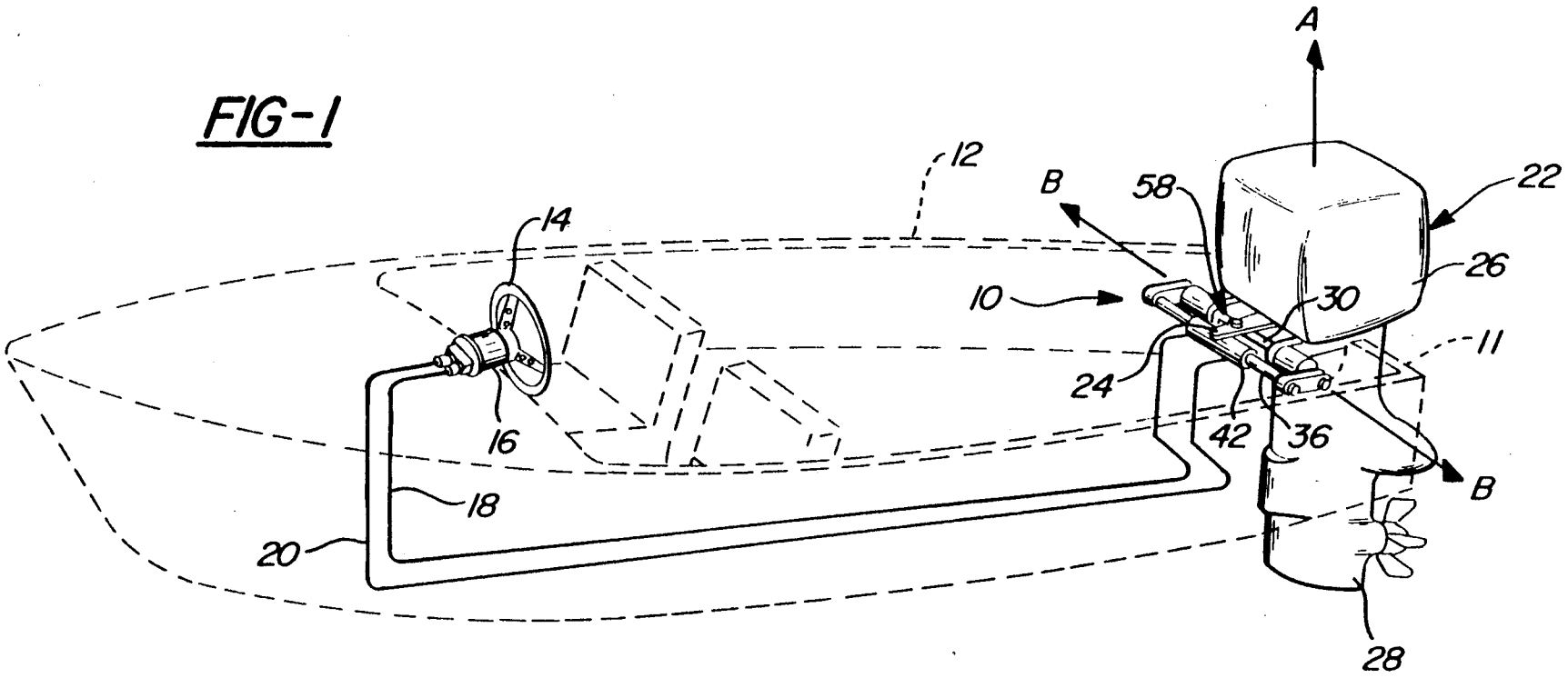
FIG. 1 is an environmental view of the subject invention disposed for operation on a boat.

Referring to the Figures, wherein like numerals indicate like or corresponding parts throughout the several views, a hydraulic steering assembly according to the subject invention is generally shown at 10. The steering assembly 10 is supported adjacent the stern 11 of a marine craft, or boat, shown in phantom at 12 in FIG. 1. A steering control device, such as a steering wheel 14, is located remotely from the steering assembly 10. A hydraulic pump 16 is operatively connected to the steering wheel 14 for delivering hydraulic fluid under pressure to the steering assembly 10. Two hydraulic fluid lines 18, 20 extend from the hydraulic pump 16 to the steering assembly 10. As the steering wheel 14 is rotated in one direction, hydraulic fluid is pumped through one of the lines 18, 20 to the steering assembly 10, and the other of the lines 18, 20 conveys return fluid back to the hydraulic pump 16 forming a closed circuit.

The subject invention is particularly adapted for controlling an outboard propulsion unit, or engine, generally indicated at 22. Such engines 22 are supported for rotation about a steering axis A which extends in a generally vertical direction when the engine 22 is disposed in an operational position. A tiller arm 24 is fixedly attached to the engine 22 and extends radially from the steering axis A into the inner compartment of the boat 12. Force applied to the tiller arm 24 causes the engine 22 to rotate about the steering axis A thereby directing the course of travel of the boat 12. The steering assembly 10 is connected between the stern 11 of the boat 12 and the tiller arm 24, as will be described in detail subsequently, to urge the tiller arm 24 to rotate about the steering axis A in controlled movements.

The engine 22 includes a power head section 26 containing the engine, electrical system, etc., and a lower unit 28 containing the gear box, gear change mechanism, propeller shaft, etc. The entire engine 22 is supported over a transom 29 of the boat 12 upon a tilt axis B. The tilt axis B extends in a generally horizontal direction between the power head 26 and the lower unit 28 and is disposed on the inboard side of the stern 11. In other words, the tilt axis B is generally perpendicular to the steering axis A. The steering axis A remains continuously perpendicular to the tilt axis B even when the engine 22 is rotated about the tilt axis B. When it is desired to trim the engine 22, or to rotate the lower unit 28 out of the water, such as when in shallow water, the entire engine 22 is tilted about the tilt axis B with the power head 26 swinging into the inner compartment of the boat 12.

Figure 2:
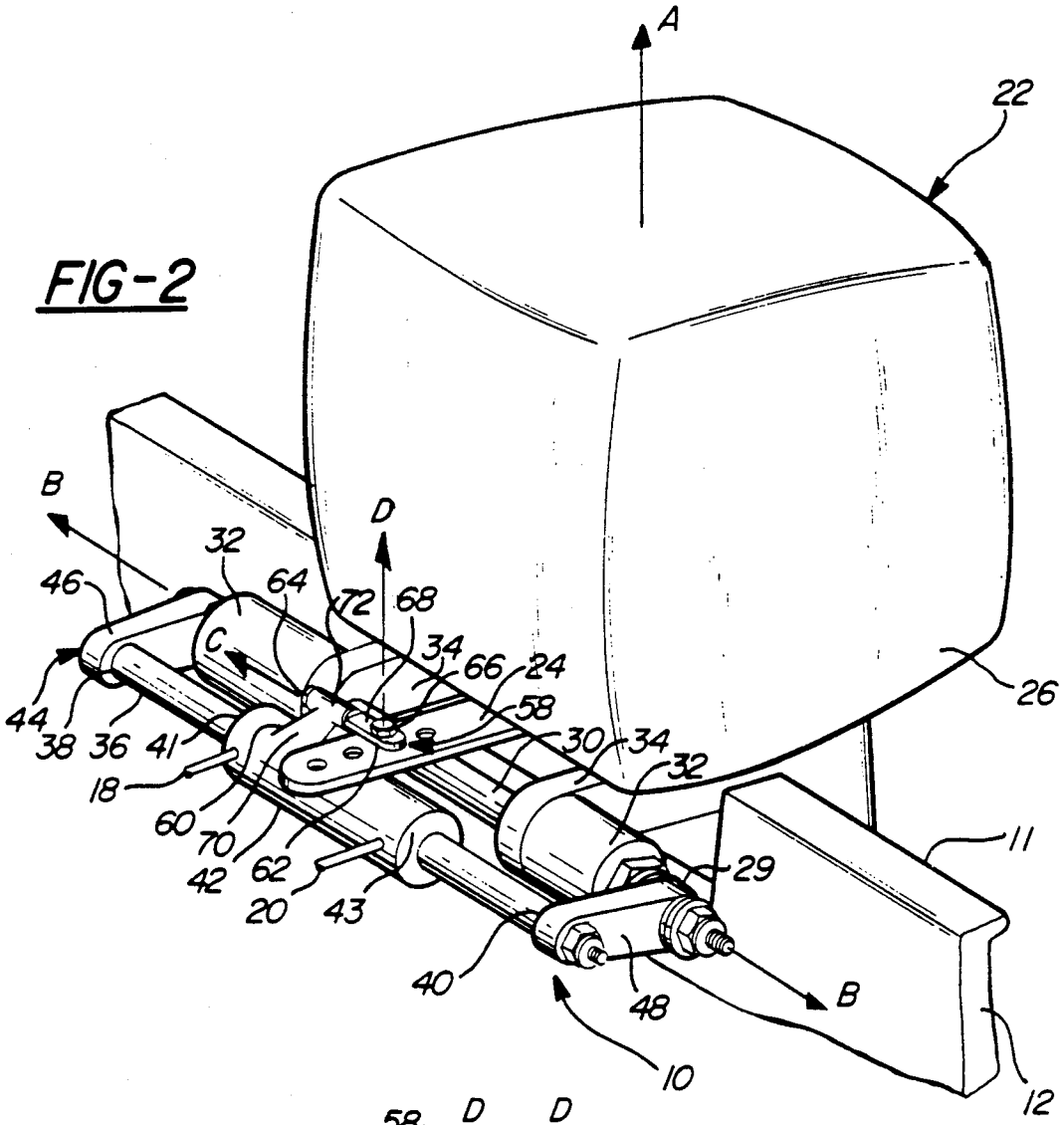
FIG. 2 is a perspective view of the subject invention attached to the tiller arm of an outboard motor.
Figures 3, 5:
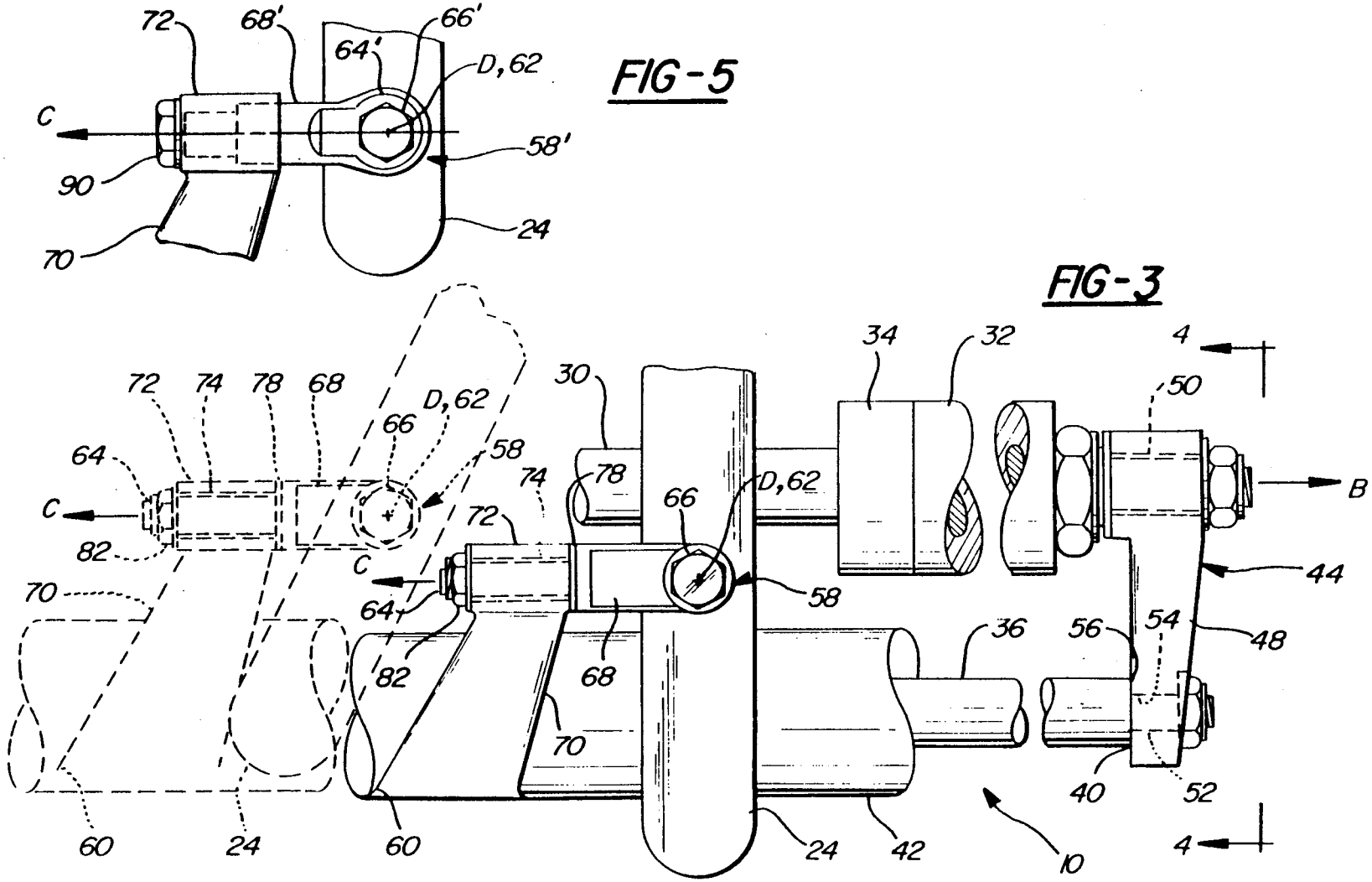
FIG. 3 is a top view of a portion of the subject steering assembly.
FIG. 5 is a top view of an alternative connector means embodiment.

Referring now to FIGS. 2 and 3, a tilt tube 30 is shown extending along, or coincidently with, the tilt axis B. The tilt tube 30 is supported adjacent the transom 29 of the boat 12 by two spaced braces 32. Two transom mounts 34 extend from and are fixedly attached to the engine 22 for pivotal connection to the tilt tube 30.

The subject steering assembly 10 includes an elongated piston rod 36 extending between a left terminal end 38 and a right terminal end 40. Although not shown in the Figures, a piston is fixed annularly about the piston rod 36 midway between the terminal ends 38 and 40. A cylinder 42 surrounds the rod 36 and is linearly moveable therealong. That is, the cylinder 42 is disposed about the piston rod 36 and the piston, and is responsive to hydraulic fluid pressure from the pump 16 for travelling between the ends 38, 40 of the piston rod 36.

The hydraulic line 18 extending from the hydraulic pump 16 is attached to one end 41 of the cylinder 42 adjacent the left terminal end 38 of the piston rod 36, and the other hydraulic line 20 is attached in fluid communication with the other end 43 of the cylinder 42 adjacent the right terminal end 40 of the piston rod 36. Although not shown in detail, a hydraulic seal is disposed in each end 41, 43 of the cylinder 42 in tight surrounding engagement with the piston rod 36 to prevent fluid leakage through the interface between each end 41, 43 of the cylinder 42 and the piston rod 36. Therefore, as hydraulic fluid is pumped through the line 18, fluid entering the cylinder 42 urges the left end 41 of the cylinder 42 to move toward the left terminal end 38 of the piston rod 36. Conversely, as hydraulic fluid is pumped through the line 20, fluid entering the cylinder 42 urges the right end 43 of the cylinder 42 to travel along the piston rod 36 toward the right terminal end 40.

Figure 4:
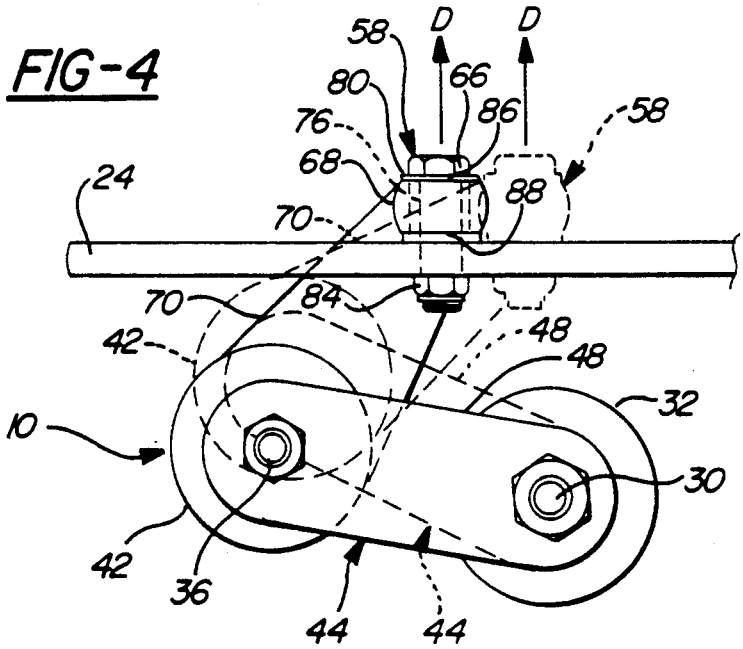
FIG. 4 is an end view of the steering assembly as seen along lines 4—4 of FIG. 3.

A support means is generally indicated at 44 in FIGS. 2–4 for supporting the rod 36 parallel to the tilt axis B and allowing arcuate movement of the rod 36 about the tilt axis B while maintaining the rod 36 parallel to the tilt axis B. That is, the support means 44 supports the piston rod 36 in a continuously parallel and rotatable relationship to the tilt tube 30. The support means 44 allows the piston rod 36, and its associated cylinder 42, to move in an arcuate path about the tilt tube 30, while maintaining the piston rod 36 parallel to the tilt tube 30. The support means 44 includes a left bracket 46 extending radially from adjacent the left end 38 of the rod 36 toward the tilt axis B, and a right bracket 48 extending radially from adjacent the right end 40 of the rod 36 toward the tilt axis B. More particularly, the tilt tube 30 extends through each of the braces 32 and the transom mounts 34 and supports the left 46 and right 48 brackets in such a manner as to allow arcuate movement of the piston rod 36 while maintaining it a fixed distance from the braces 32 and transom mounts 34.

As best shown in FIG. 3, the support means 44 includes tilt bearing means 50 disposed between the tilt tube 30 and the left bracket 46 and also between the tilt tube 30 and right bracket 48 for reducing sliding friction. Preferably, the tilt bearing means 50 comprises a sleeve type bushing allowing each of the left 46 and right 48 support brackets to rotate about the tilt tube 30 while the tilt tube 30 remains stationarily fixed within the braces 32 and transom mounts 34.

As such, the piston rod 36 is nonrotatably attached to the distal ends of each of the left 46 and right 40 support brackets. The piston rod 36 includes a reduced diameter end portion, or shank 52, adjacent each the left 38 and right 40 ends. The shank portions 52 extend straight and axially from the rod 36 through a matingly shaped bore 54 in each of the left 36 and right 40 brackets. Each shank portion 52 is threaded to receive a nut 56 thereby fixedly securing the piston rod 36 to each of the brackets 46, 48. This mounting arrangement is particularly advantageous in that a shoulder 56 is formed in the piston rod 36 between the rod 36 proper and the shank portion 52. The shoulder 56 bears against the inward surfaces of the left 46 and right 48 brackets, and coupled with the reduced diameter shanks 52 disposed through tight fitting bores in each of the brackets 46, 48, prevents the piston rod 36 from rotating, or racking, away from the brackets 46, 48 during operation.

The subject steering assembly 10 is characterized by including a connector means, generally indicated at 58 in FIGS. 2–4, for pivotally connecting a fixed predetermined point 60 between the ends 41, 43 of the cylinder 42 to a fixed predetermined point 62 on the tiller arm 24. In other words, the connector means 58 of the subject invention is attached to a predetermined point 60 on the cylinder 42 and also a predetermined point 62 on the tiller arm 24 and, during operation, does not detach from either of those predetermined points 60, 62. The connector means 58 has a predetermined length measured from the predetermined point 60 on the cylinder 42 to the predetermined point 62 on the tiller arm 24. This predetermined length does not vary, but is fixed throughout operation of the assembly 10. Therefore, the distance between the point 60 and the point 62 remains constant.

The connector means 58 of the subject invention functions as a universal joint allowing relative movement, or more particularly rotation, between the predetermined point 60 on the cylinder 42 and the predetermined point 62 on the tiller arm 24 about at least two non-parallel axes C, D while the cylinder 42 moves linearly and the tiller arm 24 moves arcuately and while the rod 36 remains parallel to the tilt axis B. That is, because the tiller arm 24 moves in an arcuate path about the steering axis A, and the cylinder 42 is restricted to linear motion along the piston rod 36, the connector means 58 must compensate for the differences between the two different motions in the manner of a universal joint. By providing the two non-parallel axes C, D of rotation in the connector means 58, forces are transferred between the cylinder 42 and tiller arm 24 along directions continuously parallel to the rod 36, thereby reducing stresses between the rod 36 and the cylinder 42. More particularly, the stresses applied to the hydraulic seals disposed in each end 41, 43 of the cylinder 42 are reduced by allowing the predetermined point 60 on the cylinder 42 to approach a midpoint between the ends 41, 43 thereof.

The connector means 58 includes a first pivotal member 64 having an axis of rotation C disposed generally parallel to the rod 36 and the tilt axis B. The connector means 58 also includes a second pivotal member 66 having an axis of rotation D adapted to pass through the tiller arm 24 at an angle generally perpendicular to the first pivotal member axis C. The connector means 58 further includes a force transmitting link 68 extending between the first 64 and second 66 pivotal members.

The cylinder 42 includes a force transmitting arm 70 extending radially outwardly therefrom to a distal end 72. The distal end 72 of the arm 70 is rotatably connected to the first pivotal member 64 for rotation about the axis C. The link 68 and the distal end 72 of the arm 70 are disposed in a contiguous, or nearly contiguous, relationship whereby force transmitted from the cylinder 42, through the arm 70 and into the first pivotal member 64 is directly transferred to the link 68, and subsequently to the second pivotal member 66 and then the tiller arm 24.

The connector means 58 further includes a first bearing means 74 disposed between the first pivotal member 64 and the arm 70 for reducing sliding friction therebetween. As best shown in FIG. 3, the first bearing means 74 comprises a sleeve-like member disposed about the first pivotal member 64, and is preferably made from a non-corrosive material. Likewise, the connector means 58 also includes a second bearing means 76 disposed between the second pivotal member 66 and the link 68 for reducing the sliding friction therebetween. The second bearing means 76 is best shown in FIG. 4 and, similar to the first bearing means 74, comprises a sleeve-like member disposed about the second pivotal member 66. The first bearing means 74 also includes an annular, washer-like bearing member disposed between the arm 70 and the link 68. The second bearing means 76, in similar fashion, also includes an annular washer-like member disposed between the link 68 and the tiller arm 24.

As best shown in FIG. 3, the first pivotal member 64 comprises a shank-like portion disposed through the distal end 72 of the arm 70 and fixedly connected to the link 68. The link 68 has a larger peripheral measure (about the axis C) than the first pivotal member 64. A shoulder extends radially outwardly from the first pivotal member 64 forming a bearing surface against which the first annular washer 78 contacts. The end of the first pivotal member 64 opposite the link 68 is preferably threaded to receive a threaded fastener 82 for securing the first pivotal member 64 and link 68 to the distal end 72 of the arm 70.

As shown in FIGS. 3 and 4, the second pivotal member 66 preferably comprises a bolt having a smooth shank portion adapted to engage the second bearing means 76, and a threaded portion extending from the shank portion which extends through an opening in the tiller arm 24. A threaded fastener 84 is disposed over the threaded end of the second pivotal member 66 for securing the link 68 to the tiller arm 24. As shown in profile in FIG. 4, the link 66 has parallel load bearing surfaces 86, 88 disposed in spaced planes parallel to the first pivotal member axis C and perpendicular to the second pivotal member axis D. These parallel load bearing surfaces 86, 88 facilitate the connection of the link 68 to the tiller arm 24.

In operation, the connector means 58 of the subject hydraulic steering assembly 10 transfers the linear motion of the cylinder 42 into arcuate motion at the tiller arm 24 while allowing relative rotation between the predetermined point 60 on the cylinder 42 and the predetermined point 62 on the tiller arm 24 about the first pivotal member axis C and the perpendicular second pivotal member axis D. The connector means 58 functions also to transfer the force from the cylinder 42 to the tiller arm 24 along a direction which is always parallel to the piston rod 36 so that bending moments between the cylinder 42 and the piston rod 36 are reduced and so that the predetermined point 60 on the cylinder 42 can approach a midpoint between the ends 41, 43 of the cylinder 42.

More particularly, as the cylinder 42 travels along the piston rod 36, four simultaneous movements of the steering assembly 10 can be observed. As referenced above, the connector means 58 rotates about the first pivotal member axis C and simultaneously rotates about the second pivotal member axis D. However, because the predetermined point 62 on the tiller arm 24 is moving away from the predetermined point 60 on the cylinder 42, the cylinder 42 moves closer to the tiller arm 24 by rotation of the left 46 and right 48 brackets about the tilt tube 30. In other words, as the tiller arm 24 moves from a straight ahead position to a hard over position (shown in phantom in FIG. 3), the entire piston rod 36 and cylinder 42 are rotated about the tilt axis B in order to maintain the constant spacing between the predetermined point 60 on the cylinder 42 in the predetermined point 62 on the tiller arm 24. As the cylinder 42 is thus moving arcuately about the tilt axis B, the arm 70 connected to the first pivotal member 64 urges the cylinder 42 to rotate about the piston rod 36. That is, as the tiller arm 24 and cylinder 42 move relative to one another, the connector means 58 causes rotation about the second pivotal member axis D, about the first pivotal member axis C, about the tilt axis B and of the cylinder 42 about the piston rod 36 in order to maintain a constant spacing between the predetermined point 60 on the cylinder 42 and the predetermined point 62 on the tiller arm 24.

The connector means 58, therefore, functions as a type of universal joint between the hydraulic steering assembly 10 and the tiller arm 24 to allow a fixed connection between two predetermined points 60, 62 while transferring forces continually along lines parallel to the piston rod 36. Said another way, the connector means 58 is a compact type of swivel connection between the cylinder 42 and the tiller arm 24. The compactness of the connector means 58 enables the predetermined point 60 on the cylinder 42 to be fixed at a position very near the midpoint between the ends 41, 43 of the cylinder 42. As will be appreciated, the closer the predetermined point 60 is positioned to the midpoint between the ends 41, 43 of the cylinder 42, the more evenly stresses can be distributed between the hydraulic seals disposed in each end 41, 43 of the cylinder 42, and thereby reduce the chances of premature failure.

DESCRIPTION OF THE ALTERNATIVE EMBODIMENT OF FIG. 5

An alternative connector means 58' is illustrated in FIG. 5. The connector means 58' includes a first pivotal member 64', a second pivotal member 66' and a link member 68'. The second pivotal member 66' is similar to the second pivotal member 66 described in connection with FIGS. 3 and 4, and generally comprises a bolt-like member extending through and fastened to the tiller arm 24. However, the link member 68' is fixed directly to the distal end 72 of the arm 70 by way of a fastening bolt 90. In this alternative embodiment, the first pivotal member 64' functions to interconnect the link 68' and the second pivotal member 66'. More specifically, the first pivotal member 64' has a generally spherical shape and surrounds the second pivotal member 66'. The first pivotal member 64' is disposed within a matingly shaped socket in the link member 68' and supported therein for arcuate movement about the first pivotal member axis C'.

As will be appreciated, the alternative embodiment of the connector means 58' shown in FIG. 5 functions in much the same manner as the embodiment of the connector means 58 shown in FIGS. 3 and 4.

DESCRIPTION OF THE ALTERNATIVE EMBODIMENT OF FIGS. 6–7

Figure 6:
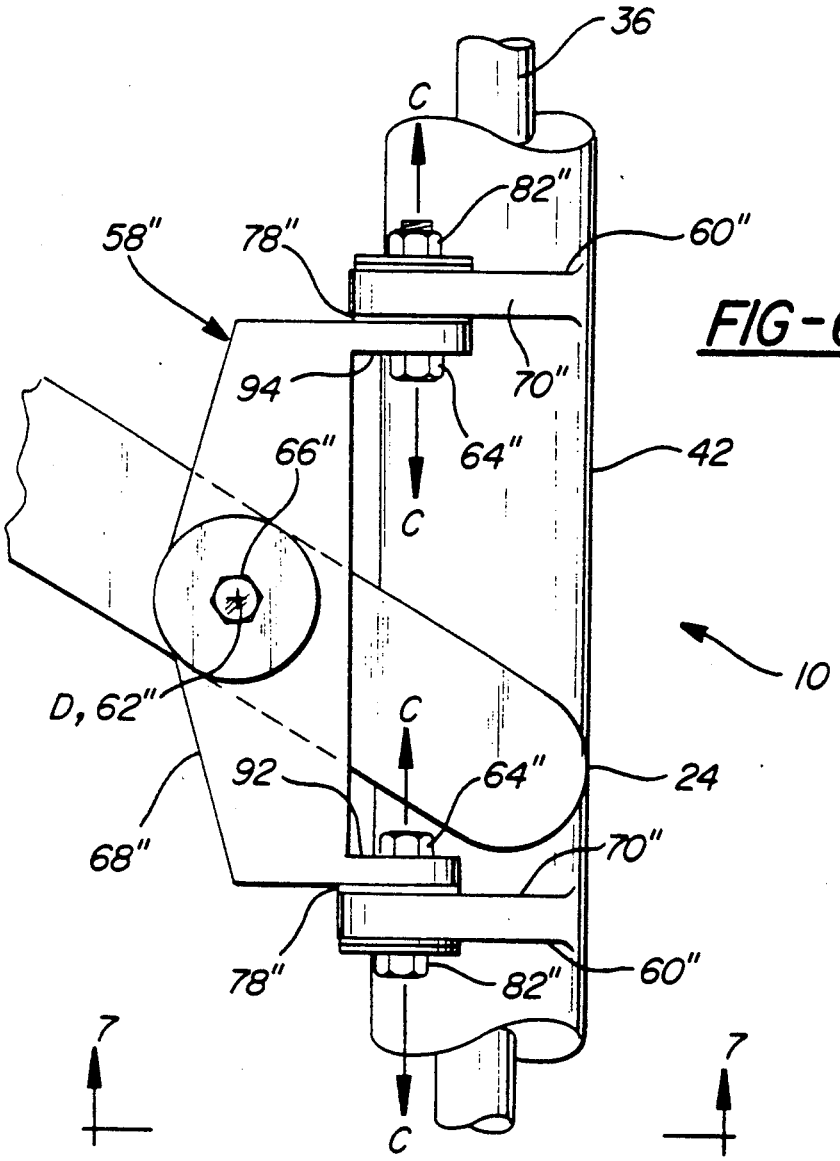
FIG. 6 is a top view of yet another connector means embodiment.
Figure 7:
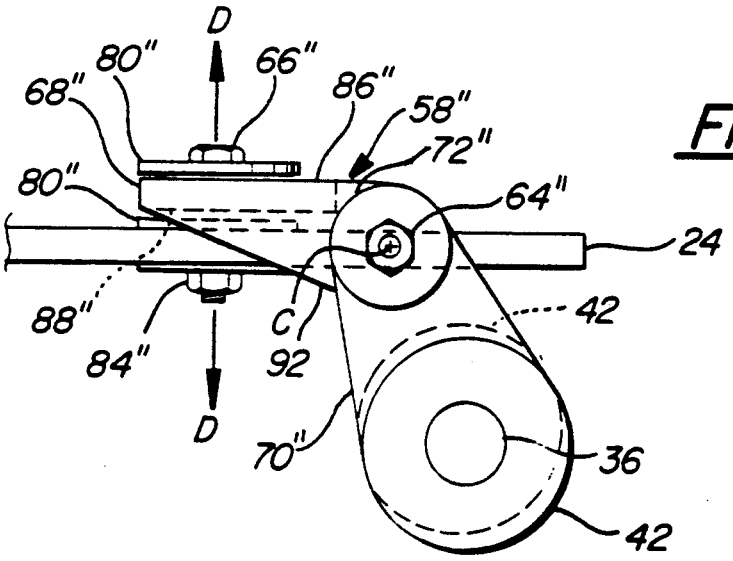
FIG. 7 is an end view of the alternative steering assembly as seen along lines 7—7 of FIG. 6.

The alternative embodiment shown in FIGS. 6–7 comprises yet another connector means 58'' adapted to minimize arcuate movement of the cylinder 42 about the tilt axis B. In many applications, it is impractical or undesirable for the cylinder 42 to sweep a relatively large arc about the tilt axis B, e.g., as that shown in FIG. 4. The connector means 58'' of FIGS. 6–7 functions to reduce arcuate movement of the cylinder 42 about the tilt axis B by spacing the first pivotal member axis C'' laterally away from the second pivotal member axis D''. Therefore, the first C'' and second D'' pivotal member axes are held by the connector means 58'' in a non-intersecting relationship.

As best shown in FIG. 6, the alternative connector means 58'' includes two first pivotal members 64'' pivotally connected to two respective arms 70'' extending from the cylinder 42. The first pivotal members 64'' generally comprise bolt-like members having smooth shank portions supported in first bearing means 74'' and having threaded ends adapted to receive nuts 82''. The second pivotal member 66'' is similar to that shown in FIG. 4 and extends through and is fastened underneath the tiller arm 24. The link 68'' extends from the second pivotal member 66'' to each of the first pivotal members 64''. The link 68'' includes a flat rectangular portion presenting the two parallel load bearing surfaces 86'' and 88'' for engagement with the second bearing means 76''. Two wing-like extensions 92, 94 extend perpendicularly from the flat rectangular portion of the link 68'' for pivotal connection to each of the first pivotal members 64''.

The second bearing means 76'' includes two very large annular washers 80'' for full surface-to-surface engagement with the parallel load bearing surfaces 86,'' 88'' of the link 68''. As the cylinder 42 urges the tiller arm 24 to sweep its arcuate path, the alternative connector means 58'' applies a bending moment to the second pivotal member 66'' which is taken up by the enlarged second annular washer 80''. The alternative connector 58'' is advantageous in that stresses are transferred evenly to the cylinder 42 by the two arms 70'' spaced equal distances from the midpoint of the cylinder 42. Therefore, the hydraulic seals in the ends 41, 43 of the cylinder 42 are evenly stressed during operation to prevent premature failure of one or the other of the seals. Also, as mentioned above, arcuate movement of the cylinder 42 about the tilt axis B is minimized.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A hydraulic steering assembly (10) for rotating a propulsion unit (22) about a steering axis (A) in response to a force applied to a tiller arm (24) thereof with the propulsion unit (22) being supported for arcuate movement about a tilt axis (B) generally perpendicular to the steering axis (A), said steering assembly (10) comprising: an elongated piston rod (36); a cylinder (42) surrounding said rod (36) and linearly moveable therealong; support means (44) for supporting said rod (36) parallel to the tilt axis (B) and allowing arcuate movement of said rod (36) about the tilt axis (B) while maintaining said rod (36) parallel to the tilt axis (B); and characterized by connector means (58) for pivotally connecting a fixed predetermined point (60) between the ends of said cylinder (42) to a fixed predetermined point (62) on the tiller arm (24) for allowing relative movement between said cylinder (42) and the tiller arm (24) while said rod (36) remains parallel to the tilt axis (B), said connector means (58) including two non-parallel pivotal axes (C, D) for pivotally connecting the tiller arm (24) and said support means (44) for movement as said cylinder (42) moves along said rod (36).

2. An assembly (10) as set forth in claim 1 further characterized by said connector means (58) comprising a universal joint.

3. An assembly (10) as set forth in claim 2 further characterized by said universal joint of said connector means (58) including a first pivotal member (64) having an axis of rotation (C) disposed generally parallel to said rod (36).

4. An assembly (10) as set forth in claim 3 further characterized by said universal joint of said connector means (58) including a second pivotal member (66) having an axis of rotation (D) adapted to pass through the tiller arm (24) at an angle generally transverse to said first pivotal member axis (C).

5. An assembly (10) as set forth in claim 4 further characterized by said first pivotal member axis (C″) and said second pivotal member axis (D″) being non-intersecting.

6. An assembly (10) as set forth in either claims 4 or 5 further characterized by said universal joint of said connector means (58) including a force transmitting link (68) extending between said first (64) and second (66) pivotal members.

7. An assembly (10) as set forth in claim 6 further characterized by said cylinder (42) including a force transmitting arm (70) extending radially outwardly toward and rotatably connected to said first pivotal member (64).

8. An assembly (10) as set forth in claim 7 further characterized by said connector means (58) including first bearing means (74) disposed between said first pivotal member (64) and said arm (70) for reducing sliding friction.

9. An assembly (10) as set forth in claim 8 further characterized by said connector means (58) including second bearing means (76) disposed between said second pivotal member (66) and said link (68) for reducing sliding friction.

10. An assembly (10) as set forth in claim 9 wherein said rod (36) extends between a left terminal end (38) and a right terminal end (40), further characterized by said support means (44) including a left bracket (46) extending radially from adjacent said left end (38) of said rod (36) toward the tilt axis (B) and a right bracket (48) extending radially from adjacent said right end (40) of said rod (36) toward the tilt axis (B).

11. An assembly (10) as set forth in claim 10 further characterized by said rod (36) including a reduced diameter shank portion (52) disposed at each of said left (38) and said right (40) terminal ends and adapted to pass through a close tolerance bore (54) in each of said left (46) and right (48) brackets, respectively.

12. An assembly (10) as set forth in claim 11 further characterized by each of said reduced diameter shank portions (52) including threaded ends adapted to receive a threaded fastener.

13. An assembly (10) as set forth in claim 12 further characterized by said support means (44) including a tilt tube (30) extending between said left bracket (46) and said right bracket (48) and adapted for disposition along the tilt axis (B).

14. An assembly (10) as set forth in claim 13 further characterized by said support means (44) including tilt bearing means (50) disposed between said tilt tube (30) and said left bracket (46) and between said tilt tube (30) and said right bracket (48) for reducing sliding friction.

15. An assembly (10) as set forth in claim 14 further characterized by said link (68) having parallel load bearing surfaces (86, 88) disposed in spaced planes parallel to said first pivotal member axis (C) and perpendicular to said second pivotal member axis (D).

16. An assembly (10) as set forth in claim 15 further characterized by said link (68″) including a portion thereof extending laterally from each side of said second pivotal member (66″), and two spaced extensions (92, 94) disposed perpendicularly of said portion for connection to said cylinder (42).

17. An assembly (10) as set forth in claim 15 further characterized by said link (68′) being fixedly attached to said distal end (72) of said arm (70) and said first pivotal member (64′) being disposed between said link (68′) and said second pivotal member (66′).

18. A hydraulic steering assembly (10) for rotating a propulsion unit (22) about a steering axis (A) in response to a force applied to a tiller arm (24) thereof with the propulsion unit (22) being supported for arcuate movement about a tilt axis (B) generally perpendicular to the steering axis (A), said steering assembly (10) comprising: an elongated piston rod (36); a cylinder (42) surrounding said rod (36) and linearly moveable therealong; support means (44) for supporting said rod (36) parallel to the tilt axis (B) and allowing arcuate movement of said rod (36) about the tilt axis (B) while maintaining said rod (36) parallel to the tilt axis (B); and characterized by connector means (58) for pivotally connecting a fixed predetermined point between the ends of said cylinder (42) to a fixed predetermined point on the tiller arm (24) for transferring forces between said cylinder (42) and the tiller arm (24) along directions continuously parallel to the rod (36) whereby stresses between said rod (36) and said cylinder (42) are reduced, said connector means (58) comprising a universal joint.

19. An assembly (10) as set forth in claim 18 further characterized by said connector means (58) including a first pivotal member (64) having an axis of rotation (C) disposed generally parallel to said rod (36).

20. An assembly (10) as set forth in claim 19 further characterized by said connector means (58) including a second pivotal member (66) having an axis of rotation (D) adapted to pass through the tiller arm (24) at an angle generally transverse to said first pivotal member axis (C).

21. An assembly (10) as set forth in claim 20 further characterized by said first pivotal member axis (C″) and said second pivotal member axis (D″) being non-intersecting.

22. An assembly (10) as set forth in either one of claims 18 or 19 further characterized by said connector means (58) including a force transmitting link (68) extending between said first (64) and second (66) pivotal members.

23. An assembly (10) as set forth in claim 22 further characterized by said cylinder (42) including a force transmitting arm (70) extending radially outwardly toward and rotatably connected to said pivotal first member.

24. An assembly (10) as set forth in claim 23 further characterized by said connector means (58) including first bearing means (74) disposed between said first pivotal member (64) and said arm (70) for reducing sliding friction.

25. An assembly (10) as set forth in claim 24 further characterized by said connector means (58) including second bearing means (76) disposed between said second pivotal member (66) and said link (68) for reducing sliding friction.

26. An assembly (10) as set forth in claim 25 wherein said rod (36) extends between a left terminal end (38) and a right terminal end (40), further characterized by said support means (44) including a left bracket (46) extending radially from adjacent said left end (38) of said rod (36) toward the tilt axis (B) and a right bracket (48) extending radially from adjacent said right end (40) of said rod (36) toward the tilt axis (B).

27. An assembly (10) as set forth in claim 26 further characterized by said rod (36) including a reduced diameter shank portion (52) disposed at each of said left (38) and said right (40) terminal ends and adapted to pass through a close tolerance bore (54) in each of said left (46) and right (48) brackets, respectively.

28. An assembly (10) as set forth in claim 27 further characterized by each of said reduced diameter shank portions (52) including threaded ends adapted to receive a threaded fastener.

29. An assembly (10) as set forth in claim 28 further characterized by said support means (44) including a tilt tube (30) extending between said left bracket (46) and said right bracket (48) and adapted for disposition along the tilt axis (B).

30. An assembly (10) as set forth in claim 29 further characterized by said support means (44) including tilt bearing means (50) disposed between said tilt tube (30) and said left bracket (46) and between said tilt tube (30) and said right bracket (48) for reducing sliding friction.

31. An assembly (10) as set forth in claim 30 further characterized by said link (68) having parallel load bearing surfaces (86, 88) disposed in spaced planes parallel to said first pivotal member axis (C) and perpendicular to said second pivotal member axis (D).

32. An assembly (10) as set forth in claim 31 further characterized by said link (68″) including a portion thereof extending laterally from each side of said second pivotal member (66″), and two spaced extensions (92, 94) disposed perpendicularly of said portion for connection to said cylinder (42).

33. An assembly (10) as set forth in claim 31 further characterized by said link (68′) being fixedly attached to said distal end (72) of said arm (70) and said first pivotal member (64′) being disposed between said link (68′) and said second pivotal member (66′).

34. A hydraulic steering assembly (10) for steering a marine craft, said steering assembly (10) comprising: a propulsion unit (22) adapted to be supported exteriorly of the marine craft (12) for arcuate movement about a tilt axis (B) and arcuate movement about a steering axis (A) disposed generally perpendicular to said tilt axis (B); said propulsion unit (22) including a tiller arm (24) extending radially from said steering axis (A); a left support bracket (46) extending radially from and supported for arcuate movement about said tilt axis (B); a right support bracket (48) spaced from said left support bracket (46) and extending radially from and supported for arcuate movement about said tilt axis (B); a piston rod (36) fixedly extending between said left (46) and right (48) support brackets parallel to said tilt axis (B); a cylinder (42) disposed for travel along said piston rod (36) between said left (46) and right (48) support brackets in response to fluid pressure; at least one arm (70) extending radially from said cylinder (42) to a distal end (72) thereof; a first pivotal member (64) connected to said distal end (72) of said arm (70) and rotatable relative to said arm (70) about an axis (C) continuously parallel to said tilt axis (B); a link (68) extending from said first pivotal member (64) to said tiller arm (24); and a second pivotal member (66) connecting said link (68) and said tiller arm (24) for relative rotation about an axis (D) continuously parallel to said steering axis (A).

* * * * *